US006729789B2

(12) United States Patent
Gordon

(10) Patent No.: US 6,729,789 B2
(45) Date of Patent: May 4, 2004

(54) TOOTHBRUSH ASSEMBLY WITH TOOTHPASTE DISPENSER

(76) Inventor: C. David Gordon, 7905 Fischer's Way, Dexter, MI (US) 48130

( * ) Notice: Subject to any disclaimer, the term of this patent is extended or adjusted under 35 U.S.C. 154(b) by 0 days.

(21) Appl. No.: 10/420,384

(22) Filed: Apr. 22, 2003

(65) Prior Publication Data

US 2003/0198503 A1 Oct. 23, 2003

Related U.S. Application Data

(60) Provisional application No. 60/374,422, filed on Apr. 22, 2002.

(51) Int. Cl.[7] ..... A46B 11/04; B43K 5/06

(52) U.S. Cl. ..... 401/278; 401/195; 401/180; 401/176; 401/273; 15/111

(58) Field of Search ..... 401/278, 195, 401/180, 176, 270, 171, 268, 273, 279; 15/111, 166

(56) References Cited

U.S. PATENT DOCUMENTS

| | | | | | |
|---|---|---|---|---|---|
| 1,212,010 | A | * | 1/1917 | Brown | 401/182 |
| 1,325,268 | A | * | 12/1919 | Sosdian | 401/278 |
| 1,742,157 | A | * | 12/1929 | Christian | 222/340 |
| 2,305,158 | A | * | 12/1942 | Hanses | 222/260 |
| 2,652,949 | A | * | 9/1953 | Martin | 222/95 |
| 3,337,893 | A | * | 8/1967 | Fine et al. | 15/111 |
| 5,480,038 | A | * | 1/1996 | Collier | 211/65 |
| 5,810,856 | A | | 9/1998 | Tveras | |
| 5,918,996 | A | | 7/1999 | Coolbaugh | |
| 6,027,273 | A | | 2/2000 | Li | |
| 6,056,469 | A | | 5/2000 | Algorri | |
| 6,129,474 | A | | 10/2000 | Mitchell et al. | |
| 6,206,600 | B1 | | 3/2001 | Rosenberg et al. | |
| 6,213,662 | B1 | | 4/2001 | Aljanedi | |
| 6,241,412 | B1 | | 6/2001 | Spies et al. | |
| 6,257,791 | B1 | | 7/2001 | Scamard | |
| 6,386,783 | B1 | * | 5/2002 | Spoelman | 401/270 |
| 6,390,103 | B1 | * | 5/2002 | Manso | 132/309 |

* cited by examiner

*Primary Examiner*—David J. Walczak
(74) *Attorney, Agent, or Firm*—MacMillan, Sobanski & Todd, LLC

(57) ABSTRACT

A toothbrush assembly includes a canister housing a spring biased piston, a cartridge for storing dentifrice (toothpaste) releasably received in the canister, and a brush head attached to a stem that is connected to the cartridge. A passage extends through the stem and connects an aperture in the brush head with an interior of the cartridge. A normally closed valve controls the flow of the dentifrice through the passage which dentifrice is pressured by the spring biased piston.

19 Claims, 3 Drawing Sheets

TOOTHBRUSH ASSEMBLY WITH TOOTHPASTE DISPENSER

CROSS-REFERENCE TO RELATED APPLICATION

This application claims the benefit of U.S. provisional patent application serial No. 60/374,422 filed Apr. 22, 2002.

BACKGROUND OF THE INVENTION

The present invention relates generally to a toothbrush apparatus and, in particular, to a toothpaste dispenser and toothbrush combination.

Toothbrushes and toothpaste dispensers are well known. Occasionally, the multiple steps of placing toothpaste from the toothpaste dispenser onto the brushes of the toothbrush become time-consuming and tedious. At other times, either the toothbrush, the toothpaste dispenser, or both, can not be located, causing frustration.

It is desirable, therefore, to provide a toothbrush having a toothpaste dispenser integral with the toothbrush body in order to overcome the disadvantages noted above. It is also desirable to provide a low cost toothbrush having a toothpaste dispenser that is reusable and/or includes replaceable components.

SUMMARY OF THE INVENTION

A toothbrush assembly in accordance with the present invention includes a canister housing a spring biased piston, a cartridge for storing dentifrice (toothpaste) that is releasably received in the canister, and a brush head attached to a stem that is connected to the cartridge. A passage extends through the stem and connects an aperture in the brush head with an interior of the cartridge. The piston fits into the open bottom end of the cartridge such that the spring forces the dentifrice to the passage in the stem. A normally closed valve is disposed in the passage or in the cartridge for controlling a flow of the dentifrice from the cartridge to the aperture in the brush head.

The toothbrush assembly in accordance with the present invention advantageously provides a toothbrush having a toothpaste dispenser integral with the toothbrush body. The toothbrush assembly in accordance with the present invention also provides a low cost toothbrush having a toothpaste dispenser that is reusable or replaceable.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
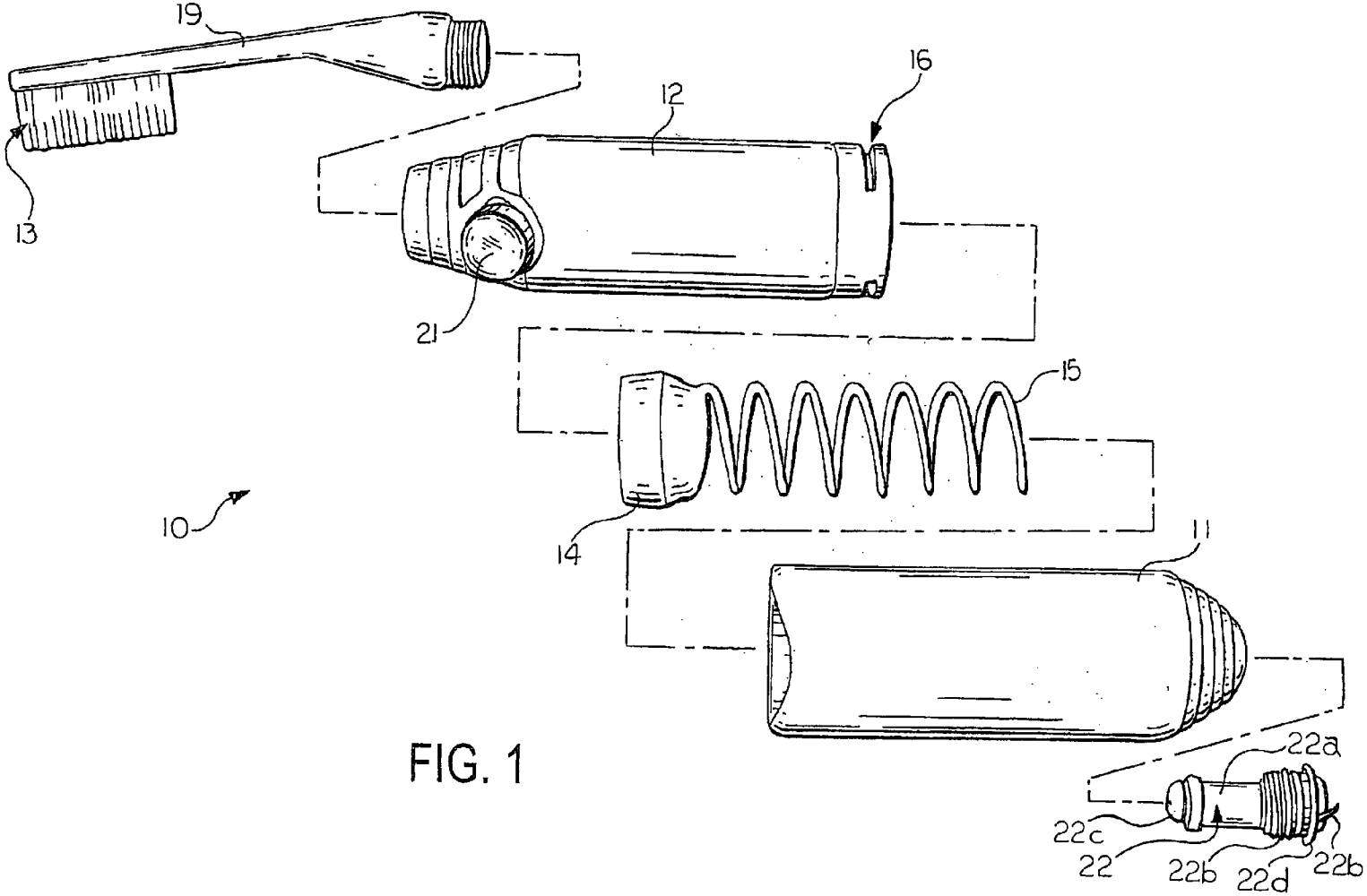
FIG. 1 is an exploded perspective view of a toothbrush assembly in accordance with the present invention.
Figure 2:
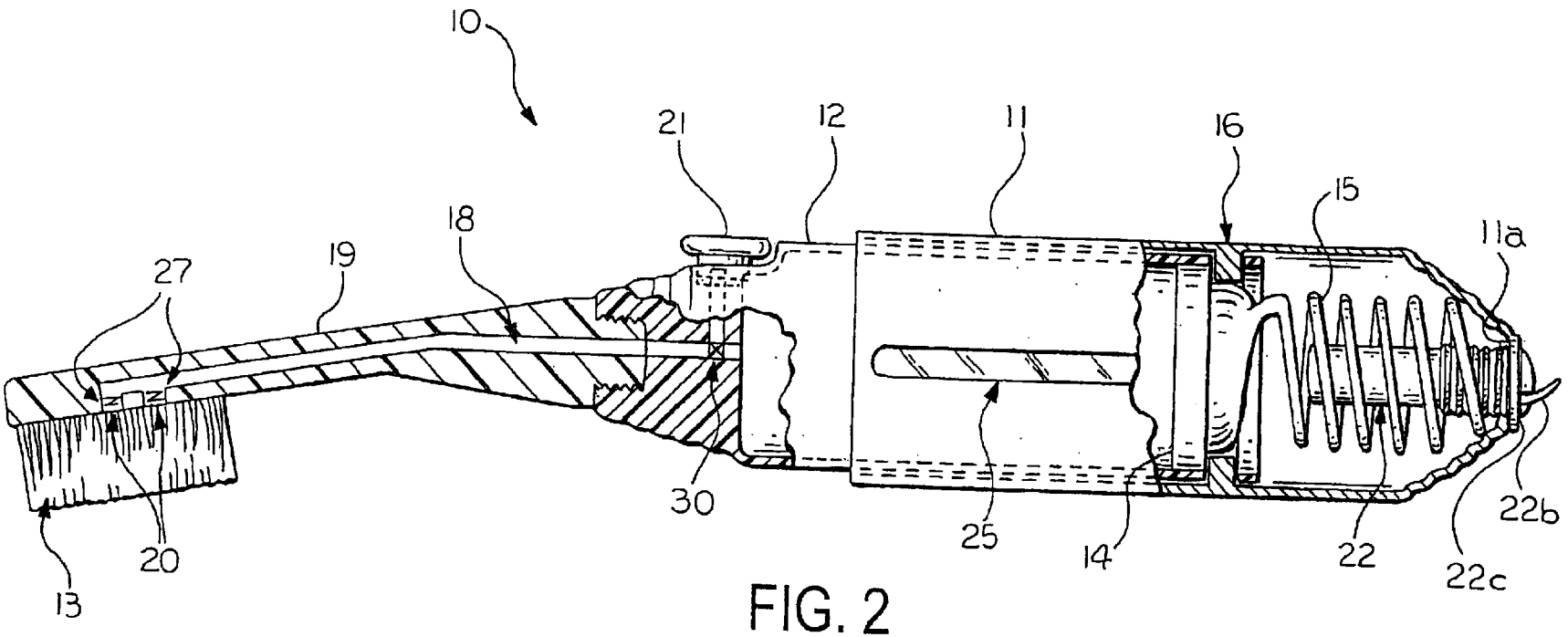
FIG. 2 is a partial cross sectional view of the toothbrush assembly in FIG. 1 shown in an assembled configuration.

Referring now to FIGS. 1 and 2, a toothbrush assembly according to the present invention is indicated generally at

10. The toothbrush assembly 10 includes a canister 11 for grasping by a human hand. An open upper end of the canister 11 is adapted to receive a dentifrice cartridge 12. Preferably, the cartridge 12 is substantially hollow with open upper and lower ends defining a dentifrice storage area therein. The open upper end of the cartridge 12 is releasably connected to a lower end of a brush head stem member 19. Preferably, the lower end of the brush head stem 19 is secured to the upper end of the cartridge 12 by a threaded connection or any suitable releasable attachment means. An upper end of the brush head stem 19 includes a brush head 13 attached thereto.

When the pre-filled cartridge 12 is inserted into the open upper end of the canister 11, the open lower end of the cartridge 12 receives a piston 14 that is slidably disposed in the interior of the canister 11. The piston 14 is biased by a compression spring 15 that is attached to a lower end of the piston 14 and engages at the interior of the lower end of the canister 11. The cartridge 12 is locked in place with the canister 11 by engaging a fitting 16 of the bayonet-type or similar fitting at the respective engaging bases of the canister 11 and the cartridge 12. In an alternative embodiment (not shown), the fitting 16 is in the form of a pair of downwardly extending tabs on the lower end of the cartridge 12 that cooperate with apertures formed near the lower end of the canister 11. The tabs clip into and can be released from the apertures through the application of finger pressure. Those skilled in the art, however, will appreciate that various means of releasably joining the cartridge 12 and the canister 11 may be utilized while remaining within the scope of the present invention.

When the cartridge 12 is filled with dentifrice and the upper end of the cartridge is blocked, as explained below, and the piston 14 will be pushed downwardly compressing the spring 15 when the cartridge 12 is inserted in the canister 11. The spring 15 applies a force to the piston 14 which pressurizes the dentifrice in the cartridge 12. When the dentifrice in the cartridge 12 is exhausted, the cartridge 12 can be removed from the canister 11 by releasing the fitting 16 from the locked position. The removed cartridge 12 can be refilled and reinserted or another already filled cartridge 12 can be inserted.

A passage 18 is formed in the interior of the brush head stem 19 and at one end is exposed to the interior of the cartridge 12. At an opposite end of the passage 18 there is at least one aperture 20 in the brush head 13. Flow of the pressurized dentifrice is controlled by a valve, indicated schematically at 30, that is operable to be actuated by a button 21 located near the top of the cartridge 12. Alternatively, the button 21 is located at the base of the brush head stem 19 (not shown) or any other suitable location on the canister 11, the cartridge 12, or the brush head stem 19. When actuated, the valve 30 opens and allows the pressurized dentifrice to flow through the passage 18 from the cartridge 12 to the apertures 20. Preferably, the valve 30 and the button 21 include a means for returning the valve 30 to the closed position after the button 21 has been released. Preferably, a check valve, indicated schematically at 27, is installed in the passage 18 adjacent each of the apertures 20 to allow flow of the dentifrice out of the apertures 20 while preventing flow of the dentifrice or water into the apertures 20.

Alternatively, a functional dental floss unit 22 is attached to the base or lower end of the canister 11. Preferably, the dental floss unit 22 is attached to the canister 11 by a threaded connection or similar connection. As shown in FIGS. 1 and 2, the dental floss unit 22 includes a flanged spool 22*a* around which a string of dental floss 22*b* is wound. The spool 22*a* is rotatably mounted on a shaft 22*c* having ahead 22*d* that threadably enrages an aperture 11*a* formed in the end of the canister 11. Thus, the dental floss unit 22 can be removed from the canister 11 by unscrewing when the floss 22*b* is exhausted and either a replacement unit 22 can be installed or a flew spool 22*a* with a supply of floss can be installed on the shaft 22*c*. As shown in FIGS. 1 and 2, the floss 22*b* can be dispensed through an opening in the head 22*d*.

Figure 3:
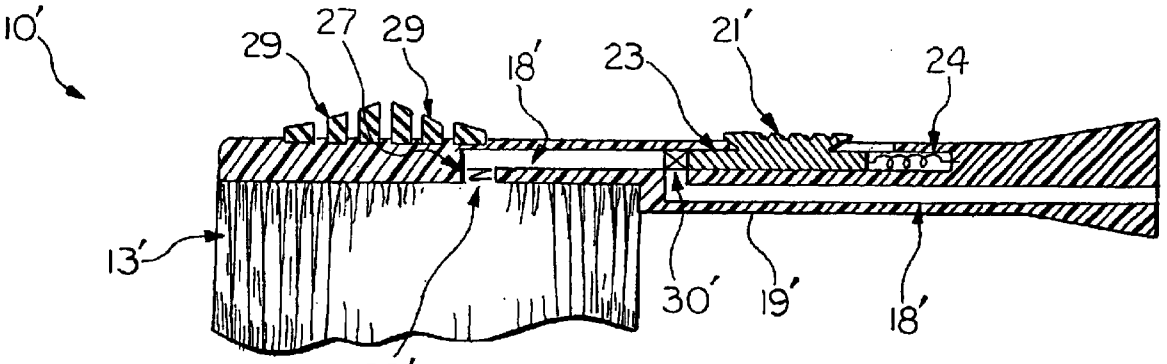
FIG. 3 is a fragmentary cross sectional view of an alternative embodiment of a brush head stem and brush head in accordance with the present invention.
Figure 4:
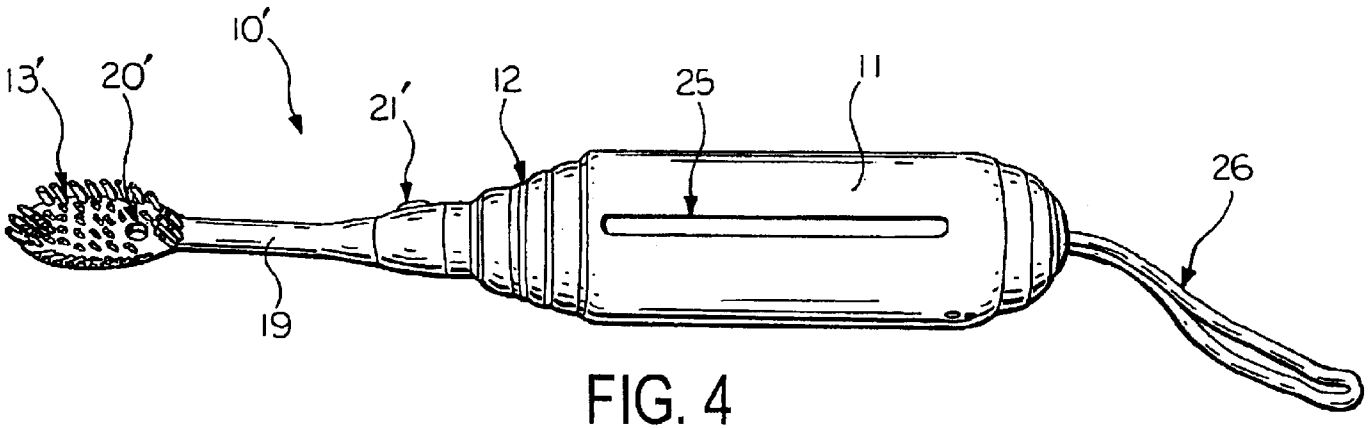
FIG. 4 is a perspective view of an alternative embodiment of a toothbrush assembly in accordance with the present invention.

Referring now to FIGS. 3 and 4, an alternative embodiment of a toothbrush assembly according to the present invention is indicated generally at 10'. In the toothbrush assembly 10', a button 21' is located at the base of a stem 19'. The button 21' is operable to slidably actuate a valve 30' and includes a bolt piston 23 that is biased to a closed position by a spring 24. By placing pressure on the button 21' to slide the button 21' away from a brush head 13', the bolt piston 23 is moved to open the valve 30' allowing the pressurized dentifrice to be forced through a passage 18' and out of an aperture 20'. When pressure on the button 21' is released, the spring 24 returns the button 21', the bolt piston 23, and the valve 30' to the closed position, preventing any further flow through the passage 18'. Those skilled in the art, however, will realize that other types of valves or valve actuators can be utilized while remaining within the scope of the present invention.

A cord or lanyard 26, best seen in FIG. 4, can be attached to the bottom end of the canister 11 or to the dental floss unit 22. As shown in FIG. 3, a rear or dorsal surface of the brush head 13' can be provided with a plurality of upstanding flexible ribs 29 to be used as a tongue scraper.

As shown in FIGS. 2 and 4, a longitudinally extending window 25 can be provided in a wall of the canister 11 with the adjacent wall of the cartridge 12 being transparent or translucent or having a window for viewing the position of the piston 14 and to observe the quantity of the dentifrice remaining in the cartridge 12. Alternatively, the canister 11 can be made of a transparent material including, but not limited to, a clear plastic material or the like.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A toothbrush assembly comprising:

a canister housing a spring biased piston;

a cartridge having a hollow interior for storing dentifrice and being releasably received in said canister with said piston extending into an open lower end of said cartridge;

a brush head stem having a brush head and being connected to said cartridge, a passage extending through said stem connecting at least one aperture formed in said brush head with said interior of said cartridge;

a check valve cooperating with said at least one aperture to permit the flow of dentifrice from said passage and out said aperture; and a normally closed valve cooperating with said passage for controlling a flow of dentifrice from said interior of said cartridge to said at least one aperture in said brush head.

2. The toothbrush assembly according to claim 1 wherein said valve is operable to be controlled by a button located on said canister.

3. The toothbrush assembly according to claim 1 wherein said valve is operable to be controlled by a button located on said brush head stem.

4. The toothbrush assembly according to claim 1 including a dental floss unit attached to said canister.

5. The toothbrush assembly according to claim 1 including a tongue scraping means attached to said brush head.

6. The toothbrush assembly according to claim 1 including a lanyard attached to said canister.

7. The toothbrush assembly according to claim 1 including a window formed in said canister for viewing dentifrice in said cartridge.

8. The toothbrush assembly according to claim 1 wherein said cartridge is attached to said canister by a bayonet-type fitting.

9. A toothbrush assembly comprising:

a substantially hollow canister having a spring biased piston disposed in an interior thereof;

a cartridge for storing dentifrice releasably received in said canister, said cartridge having an open upper end and an open lower end, said piston being received in said open lower end for sliding movement in an interior of said cartridge;

a substantially hollow stem having one end connected to said open upper end of said cartridge;

a brush head attached to another end of said stem with a passage extending through said stem connecting at least one aperture in said brush head with the interior of said cartridge;

a check valve disposed in said passage intermediate said cartridge and said at least one aperture in said brush head; and a normally closed valve operable to control the flow of dentifrice from said interior of said cartridge to said at least one aperture in said brush head.

10. The toothbrush assembly according to claim 9 wherein said valve is operable to be controlled by a button located on an exterior surface of said canister.

11. The toothbrush assembly according to claim 9 wherein said valve is operable to be controlled by a button located on an exterior surface of said stem.

12. The toothbrush assembly according to claim 9 including a dental floss unit attached to said canister.

13. The toothbrush assembly according to 9 including a tongue scraping apparatus attached to said brush head.

14. The toothbrush assembly according to claim 9 including a lanyard attached to said canister.

15. The toothbrush assembly according to claim 9 including a window formed in said canister for viewing the position of said piston in said cartridge.

16. The toothbrush assembly according to claim 9 wherein said cartridge is releasably attached to said canister by a bayonet-type fitting.

17. The toothbrush assembly according to claim 9 wherein at least another aperture is formed in said brush head.

18. A toothbrush assembly comprising:

a substantially hollow canister;

a cartridge having a hollow interior for storing dentifrice and being releasably attached to said canister;

a spring biased piston received in said canister and extending into an open end of said cartridge for pressurizing dentifrice in said cartridge interior;

a brush head stem connected to said canister, said stem having a brush head and a passage extending therethrough, said passage connecting at least one aperture formed in said brush head with said cartridge interior;

a check valve cooperating with said at least one aperture; and a selectively operable normally closed valve cooperating with said passage whereby when a quantity of dentifrice is stored in said cartridge interior, said normally closed valve is selectively operable to permit the dentifrice to flow from said cartridge interior through said passage and out said at least one aperture and said check valve prevents a return of the dentifrice through said at least one aperture to said passage.

19. The toothbrush assembly according to claim 18 including a dental floss unit attached to and enclosed by said canister.

* * * * *